US011398672B2

(12) United States Patent
Schiemann

(10) Patent No.: US 11,398,672 B2
(45) Date of Patent: Jul. 26, 2022

(54) ROOF ANTENNA

(71) Applicant: Hirschmann Car Communication GmbH, Neckartenzlingen (DE)

(72) Inventor: Rainer Schiemann, Esslingen (DE)

(73) Assignee: Hirschmann Car Communication GmbH, Neckartenzlingen (DE)

( * ) Notice: Subject to any disclaimer, the term of this patent is extended or adjusted under 35 U.S.C. 154(b) by 102 days.

(21) Appl. No.: 17/001,516

(22) Filed: Aug. 24, 2020

(65) Prior Publication Data

US 2021/0057807 A1 Feb. 25, 2021

(30) Foreign Application Priority Data

Aug. 23, 2019 (DE) ..... 102019122677.5

(51) Int. Cl.
*H01Q 1/32* (2006.01)
*H01Q 1/12* (2006.01)

(52) U.S. Cl.
CPC ..... *H01Q 1/3275* (2013.01); *H01Q 1/1207* (2013.01)

(58) Field of Classification Search
CPC ..... H01Q 1/1207; H01Q 1/3275
See application file for complete search history.

(56) References Cited

U.S. PATENT DOCUMENTS

2008/0131199 A1* 6/2008 Hildebrand ..... H01Q 1/1214 403/408.1
2018/0277922 A1 9/2018 Kim et al.

FOREIGN PATENT DOCUMENTS

DE 102010032579 A1 * 2/2011 ..... H01Q 1/1207
DE 102019211755 B3 * 12/2020 ..... F16B 23/0061
WO WO-2006136221 A * 12/2006 ..... H01Q 1/1207

* cited by examiner

*Primary Examiner* — Andrea Lindgren Baltzell
*Assistant Examiner* — Amal Patel
(74) *Attorney, Agent, or Firm* — Barley Snyder

(57) ABSTRACT

A roof antenna including an antenna base with a base plate, a spindle, a driver arranged on the spindle, and a locking element having a first limb and a second limb. The first limb has a first latching hook and the second limb has a second latching hook. The first limb and the second limb extend through an aperture in the base plate. A translatory movement of the driver on the spindle is transferred into a displacement of the locking element in a displacement direction perpendicular to the base plate.

20 Claims, 10 Drawing Sheets

ROOF ANTENNA

CROSS-REFERENCE TO RELATED APPLICATION

This application claims the benefit of the filing date under 35 U.S.C. § 119(a)-(d) of German Patent Application No. 102019122677.5, filed on Aug. 23, 2019.

FIELD OF THE INVENTION

The present invention relates to an antenna and, more particularly, to a roof antenna.

BACKGROUND

Roof antennas for mounting on a roof of a motor vehicle are known in the prior art. For mounting, many known roof antennas require access both from the upper side and from the lower side of the roof. However, access from the lower side of the roof is frequently complicated owing to a trim which is fitted there.

SUMMARY

A roof antenna including an antenna base with a base plate, a spindle, a driver arranged on the spindle, and a locking element having a first limb and a second limb. The first limb has a first latching hook and the second limb has a second latching hook. The first limb and the second limb extend through an aperture in the base plate. A translatory movement of the driver on the spindle is transferred into a displacement of the locking element in a displacement direction perpendicular to the base plate.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
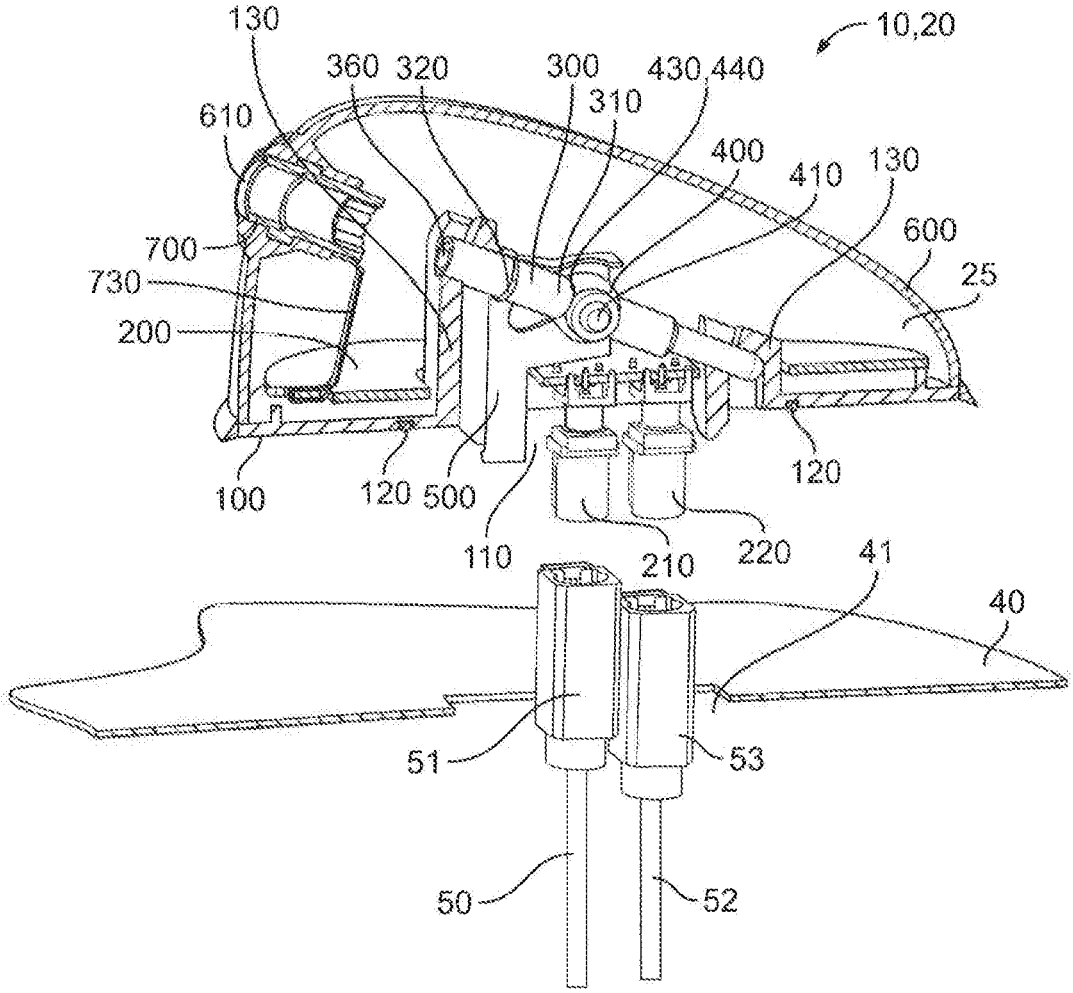
FIG. 1 is a sectional perspective view of an antenna base of a roof antenna prior to mounting.

In the following, exemplary embodiments of the invention are described with reference to the drawings. The shown and described embodiments serve explanatory purposes only. The combination of features shown in the embodiments may be changed. For example, a feature which is not shown in an embodiment but described herein may be added if the technical effect associated with this feature is beneficial for a particular application. Vice versa, a feature shown as part of an embodiment may be omitted if the technical effect associated with this feature is not needed in a particular application. In the drawings, elements that correspond to each other with respect to function and/or structure have been provided with the same reference numeral.

A roof antenna 10 according to an embodiment is shown in FIG. 1. The roof antenna 10 can be provided for mounting on a roof of a motor vehicle, for example. The roof antenna 10 can be provided, for example, for radio reception and additionally or alternatively for transmitting mobile radio signals.

FIG. 1 shows a part of an antenna base 20 of the roof antenna 10 and a part of a roof 40 with a mounting aperture 41, on which the roof antenna 10 is to be mounted. The roof 40 can be a roof of a motor vehicle, for example. An upper side or outer side of the roof 40 is shown.

The antenna base 20, as shown in FIG. 1, has a base plate 100 with a substantially planar lower side. The base plate 100 can be made of a plastics material, for example. The base plate 100 can be formed integrally or be formed from several sub-elements. The base plate 100 has an aperture 110. A sealing ring 120 bordering the aperture 110 in an annular manner is provided on a lower side of the base plate 100. However, the sealing ring 120 can also be dispensed with in other embodiments. A holder 130 is formed on an upper side of the base plate 100, opposite the lower side of the base plate 100.

The antenna base 20 further comprises a cover 600, as shown in FIG. 1. The cover 600 can be made of a plastics material, for example. The cover 600 is arranged over the upper side of the base plate 100 in such a way that an inner region 25 of the antenna base 20 is enclosed between the base plate 100 and the cover 600. The holder 130 is arranged in the inner region 25 of the antenna base 20. The inner region 25 of the antenna base 20 is accessible through the aperture 110 in the base plate 100. The cover 600 moreover has an aperture 610, through which the inner region 25 of the antenna base 20 is accessible.

As shown in FIG. 1, a circuit board 200 is arranged in the inner region 25 of the antenna base 20. The circuit board 200 can be formed as a printed circuit board (PCB), for example. The circuit board 200 can have electrical conductor tracks and electrical components and structural elements, for example. Moreover, in the example of the antenna base 20 of the roof antenna 10 shown in FIG. 1, a first plug connector 210 and a second plug connector 220 are connected to the circuit board 200. However, it is also possible for only one plug connector or more than two plug connectors to be provided. The first plug connector 210 and the second plug connector 220 extend through the aperture 110 in the base plate 100 and are therefore accessible from outside the antenna base 20.

To mount the roof antenna 10 on the mounting aperture 41 in the roof 40, the first plug connector 210 and the second plug connector 220 of the antenna base 20 are, in a first step, connected to a first cable 50 by a first plug connector mating part 51 and to a second cable 52 by a second plug connector mating part 53, shown in FIG. 1. The cables 50, 52, which are connected to the plug connector mating parts 51, 53, produce electrically conductive connections to components of the motor vehicle. The cables 50, 52 extend out of a vehicle interior through the mounting aperture 41 in the roof 40, such that the plug connector mating parts 51, 53, which are connected to the cables 50, 52, are accessible on the outer side of the roof 40. As a result, it is made possible to connect the first plug connector mating part 51, which is connected to the first cable 50, to the first plug connector 210 of the antenna base 20 and to connect the second plug connector mating part 53, which is connected to the second cable 52, to the second plug connector 220 of the antenna base 20, before the antenna base 20 of the roof antenna 10 is placed on the roof 40.

Figure 4:
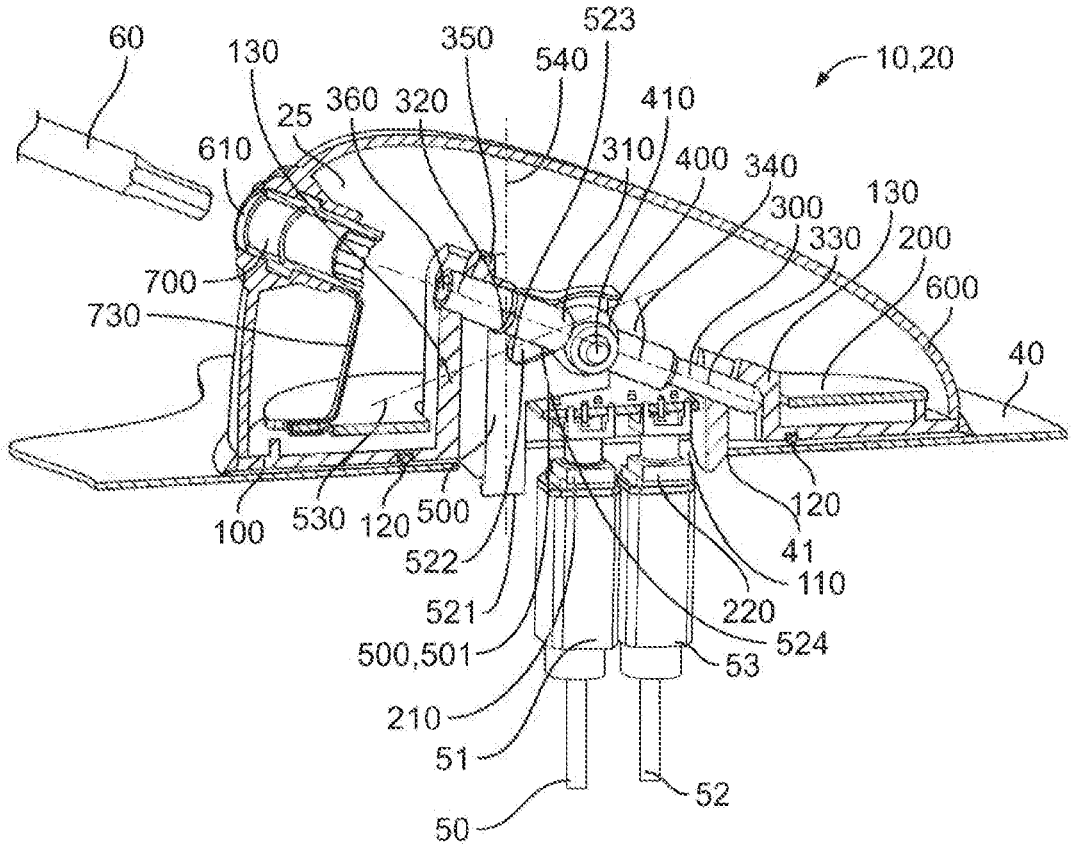
FIG. 4 is a sectional perspective view of the antenna base arranged on a mounting aperture in a roof before locking.

As shown in FIGS. 1 and 4, a spindle 300 is arranged in the inner region 25 of the antenna base 20. The spindle 300 is formed as a threaded spindle with a spindle thread 310, which is not depicted in detail in the figures. The spindle 300 has a longitudinal direction 330, and is held on the holder 130 by a securing ring 320 in such a way that the spindle 300 is rotatable about a longitudinal axis parallel to its longitudinal direction 330. At a longitudinal end, the spindle 300 has a drive profile 360, which can be formed as an internal hexagon, for example. The drive profile 360 of the spindle 300 is accessible from outside the antenna base 20 through the aperture 610 in the cover 600.

Figure 2:
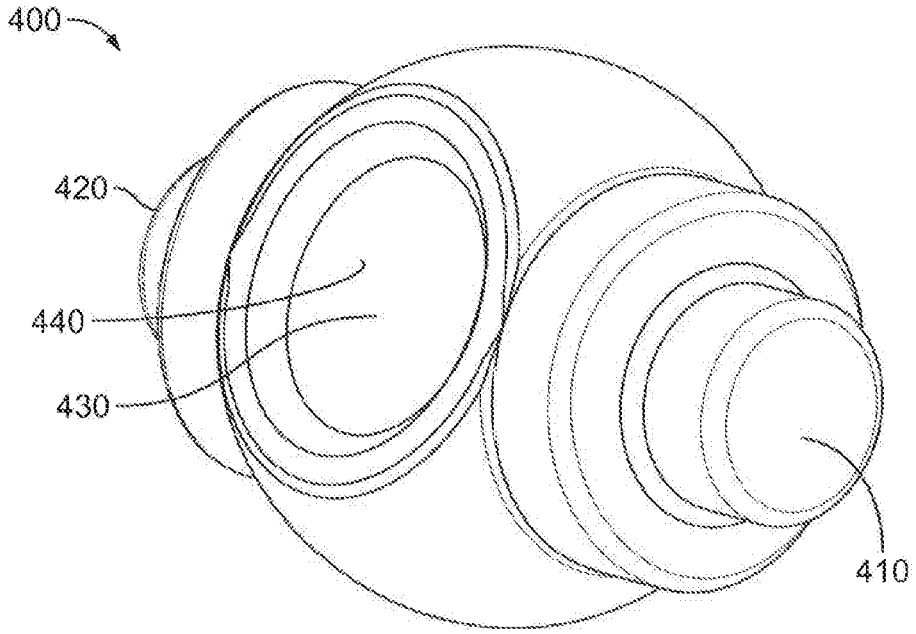
FIG. 2 is a perspective view of a driver of the roof antenna.

A driver 400 is arranged on the spindle 300, as shown in FIGS. 1 and 4. FIG. 2 shows an enlarged perspective view of the driver 400 without the other components of the roof antenna 10. The driver 400 is formed as a spindle nut and, for this purpose, has a through-aperture 430 with an inner thread 440, which is not depicted in detail in FIG. 2. The inner thread 440 of the driver 400 is formed to fit the spindle thread 310 of the spindle 300. The driver 400 is arranged on the spindle 300 in such a way that the spindle 300 extends through the through-aperture 430 of the driver 400. As a result, a rotary movement of the spindle 300 about its axis of rotation, which is parallel to its longitudinal direction 330, is converted into a translatory movement of the driver 400 along the longitudinal direction 330 of the spindle 300.

On its outer side, as shown in FIG. 2, the driver 400 has a first pin 410 and a second pin 420 which is collinear with the first pin 410, which second pin 420 is opposite the first pin 410. The first pin 410 and the second pin 420 are orientated perpendicular to the longitudinal direction 330 of the spindle 300.

Figure 3:
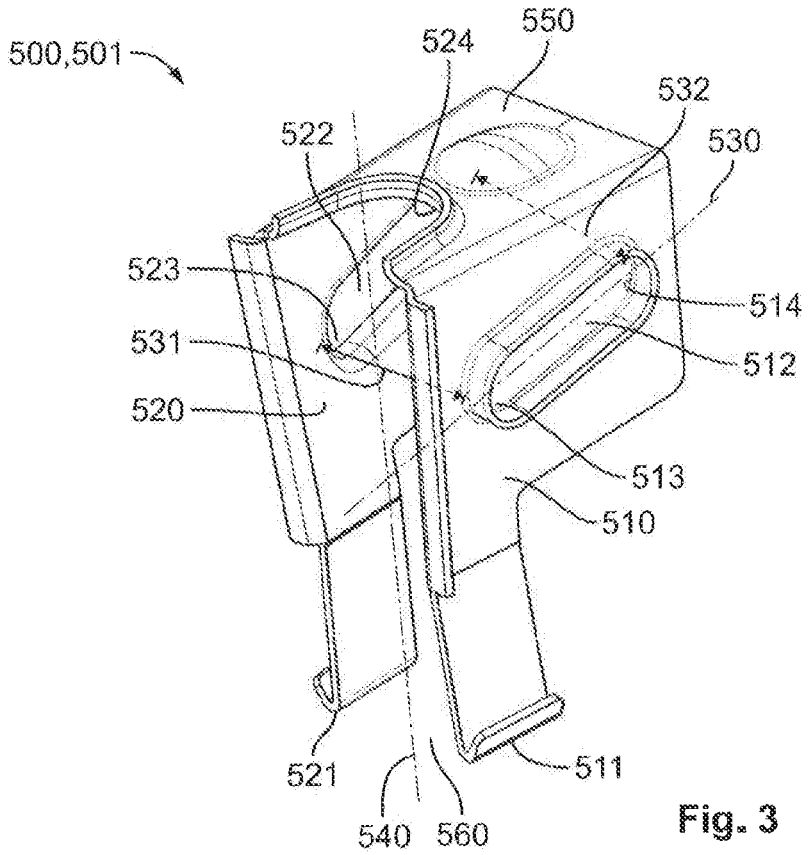
FIG. 3 is a perspective view of a locking element of the roof antenna.

FIG. 1 shows that, moreover, a locking element 500 is arranged in the inner region 25 of the antenna base 20. The locking element 500 is held on the holder 130 in such a way that the locking element 500 is displaceable along a displacement direction 540 shown in FIG. 3 orientated perpendicular to the base plate 100. FIG. 1 shows a sectional depiction of the locking element 500. FIG. 3 shows a perspective depiction of the entire locking element 500 without the other components of the roof antenna 10.

The locking element 500 if formed of an elastically deformable material, for example a metal. The locking element 500 can be manufactured from a sheet metal, for example. FIG. 3 shows the locking element 500 in an unstressed state 501, in which the locking element 500 is not resiliently deformed.

The locking element 500, as shown in FIG. 3, has a first limb 510 and a second limb 520 which is formed mirror-symmetrically to the first limb 510. The mirror plane is orientated parallel to the displacement direction 540. The first limb 510 and the second limb 520 of the locking element 500 are connected to one another via a connecting section 550. Starting from the connecting section 550, the limbs 510, 520 extend substantially parallel to the displacement direction 540. At a latching end 560 of the locking element 500, opposite the connecting section 550, the first limb 510 and the second limb 520 of the locking element 500 are free. As a result, a substantially U-shaped basic shape of the locking element 500 is produced.

As shown in FIG. 3, the first limb 510 has a first latching hook 511 at the latching end 560 of the locking element 500. The second limb 520 has a second latching hook 521 at the latching end 560 of the locking element 500. The latching hooks 511, 521 each extend outwards away from the plane of symmetry of the locking element 500. The first limb 510 of the locking element 500 has a first elongate hole 512. Correspondingly, the second limb 520 of the locking element 500 has a second elongate hole 522. The first elongate hole 512 has a first longitudinal end 513 and a second longitudinal end 514. The second elongate hole 522 has a first longitudinal end 523 and a second longitudinal end 524. In this case, the elongate holes 512, 522 each extend along a longitudinal direction 530.

The first limb 510 and the second limb 520 are not orientated exactly parallel to one another. Rather, a first spacing 531 of the limbs 510, 520 measured between the first longitudinal end 513 of the first elongate hole 512 and the first longitudinal end 523 of the second elongate hole 522 is smaller than a second spacing 532 of the limbs 510, 520 measured between the second longitudinal end 514 of the first elongate hole 512 and the second longitudinal end 524 of the second elongate hole 522.

FIG. 1 shows that the locking element 500 is arranged in the inner region 25 of the antenna base 20 in such a way that the driver 400 is arranged between the limbs 510, 520 of the locking element 500. The first pin 410 of the driver 400 is guided in the first elongate hole 512 of the first limb 510 of the locking element 500. The second pin 420 of the driver 400 is guided in the second elongate hole 522 of the second limb 520 of the locking element 500. As a result, the locking element 500 is mechanically coupled to the driver 400 in such a way that a translatory movement of the driver 400 on the spindle 300 brings about a displacement of the locking element 500 in the displacement direction 540 perpendicular to the base plate 100. The latching end 560 of the limbs 510, 520 of the locking element 500 with the latching hooks 511, 521 protrudes out of the inner region 25 of the antenna base 20 through the aperture 110 in the base plate 100.

Figure 5:
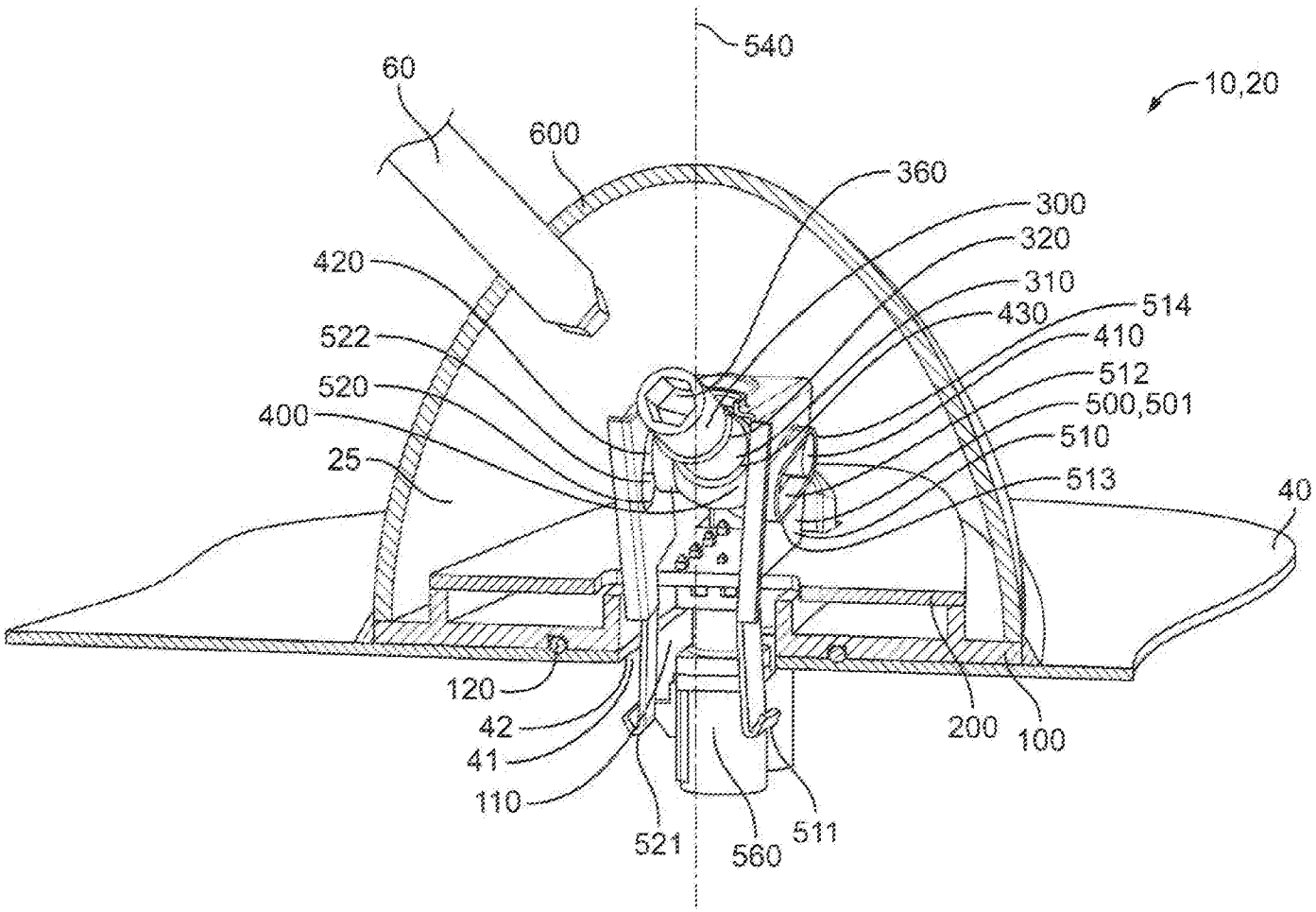
FIG. 5 is a sectional perspective view of the antenna base arranged on the mounting aperture before locking.

FIGS. 4 and 5 show perspective and in each case partially sectional depictions of the antenna base 20 during mounting of the antenna base 20 on the mounting aperture 41 in the roof 40 in a mounted state chronologically following the depiction from FIG. 1. In this case, FIGS. 4 and 5 show views from different viewing directions.

After the connecting of the plug connectors 210, 220 of the antenna base 20 to the cables 50, 52, as described with reference to FIG. 1, the antenna base 20 has been arranged over the mounting aperture 41 in the roof 40 in such a way that the lower side of the base plate 100 faces the outer side of the roof 40 and the aperture 110 in the base plate 100 is arranged over the mounting aperture 41 in the roof 40. In the example shown in FIGS. 1, 4, and 5, the plug connectors 210, 220 of the antenna base 20 extend through the mounting aperture 41 in the roof 40. However, this is not absolutely necessary. The mounting aperture 41 in the roof 40 and the aperture 110 in the base plate 100 of the antenna base 20 are sealed from the outside by the peripheral sealing ring 120. However, the sealing ring 120 can also be dispensed with. The antenna base 20 has been arranged over the mounting aperture 41 in the roof 40 in such a way that the limbs 510, 520 of the locking element 500 extend through the mounting aperture 41 in the roof 40 and the latching end 560 of the locking element 500, with the latching hooks 511, 521 arranged on the limbs 510, 520, are situated on the inner side of the roof 40.

In the situation shown in FIGS. 4 and 5, the antenna base 20 of the roof antenna 10 is still in a pre-mounting state. In this case, the driver 400 is positioned on the spindle 300 in such a way that the first pin 410 of the driver 400 is arranged close to the second longitudinal end 514 in the first elongate hole 512 of the locking element 500 and the second pin 420 of the driver 400 is arranged close to the second longitudinal end 524 in the second elongate hole 522 of the locking element 500. The locking element 500 is in the unstressed state 501, which is explained above with reference to FIG. 3. In this unstressed state 501 of the locking element 500, the spacing of the limbs 510, 520 at the latching end 560 of the locking element 500 is dimensioned in such a way that the latching end 560 can be guided through the mounting aperture 41 in the roof 40 in spite of the latching hooks 511, 521 formed at the latching end 560. The spacing of the two latching hooks 511, 521 of the locking element 500 is therefore smaller than the diameter of the mounting aperture 41 in the roof 40.

The longitudinal direction 330 of the spindle 300 forms a first angle 340 with the longitudinal direction 530 of the elongate holes 512, 522 of the locking element 500, as shown in FIG. 4. In the depicted example, the first angle 340 is less than 90 degrees. Moreover, the longitudinal direction 330 of the spindle 300 forms a second angle 350 with the displacement direction 540 of the locking element 500. In the example shown in the figures, the second angle 350 is also less than 90 degrees. As a result of this orientation of the spindle 300 and the elongate holes 512, 522 of the locking element 500 in relation to one another, the locking element 500 can be moved in the displacement direction 540 by the driver 400.

If the spindle 300 is rotated starting from the pre-mounting state shown in FIGS. 4 and 5 in such a way that the driver 400, which is arranged on the spindle 300, moves along the longitudinal direction 330 of the spindle 300, the pins 410, 420 of the driver 400, which are guided in the elongate holes 512, 522 of the locking element 500, move from the second longitudinal ends 514, 524 of the elongate holes 512, 522 in the direction of the first longitudinal ends 513, 523 of the elongate holes 512, 522 of the locking element 500. In this case, as a result of the orientation of the longitudinal direction 330 of the spindle 300 and the longitudinal direction 530 of the elongate holes 512, 522 in relation to one another, the locking element 500 is raised in the displacement direction 540 such that the latching hooks 511, 521 of the locking element 500 are pulled in the direction of the mounting aperture 41.

At the same time as the displacement of the locking element 500 in the displacement direction 540, the limbs 510, 520 of the locking element 500 are resiliently spread apart by the driver 400. The second spacing 532 between the limbs 510, 520 of the locking element 500, measured between the second longitudinal ends 514, 524 of the elongate holes 512, 522 of the locking element 500 as shown in FIG. 3, corresponds, in the unstressed state 501 of the locking element 500, approximately to the width of the driver 400 arranged between the limbs 510, 520. In contrast, the first spacing 531 of the limbs 510, 520, measured at the first longitudinal ends 513, 523 of the elongate holes 512, 522, in the unstressed state 501 of the locking element 500, is smaller than the width of the driver 400. If the driver 400 is moved in a translatory manner along the spindle 300, such that the pins 410, 420 of the driver 400 in the elongate holes 512, 522 of the locking element 500 migrate from the second longitudinal ends 514, 524 in the direction of the first longitudinal ends 513, 523, then the driver 400 presses the limbs 510, 520 of the locking element 500 resiliently apart, such that the first spacing 531 of the limbs 510, 520, measured between the first longitudinal ends 513, 523 of the elongate holes 512, 522, increases. The locking element 500 in this case is brought from its unstressed state 501 into a spread-apart state 502.

As a result of the spreading-apart of the limbs 510, 520 of the locking element 500, the spacing between the first latching hook 511, which is arranged on the first limb 510, and the second latching hook 521, which is arranged on the second limb 520, also increases. In the fully spread-apart state 502 of the locking element 500, the limbs 510, 520 of the locking element 500 are spread apart in such a way that the latching hooks 511, 521 come to bear on an edge 42 of the mounting aperture 41 in the roof 40, as shown in FIGS. 6 and 7.

The rotation of the spindle 300 about its axis of rotation, which is parallel to its longitudinal direction 330, can take place by a suitable tool 60 shown in FIGS. 4 and 5, which is inserted through the aperture 610 in the cover 600 of the antenna base 20 into the inner region 25 of the antenna base 20 and engages on the drive profile 360 of the spindle 300. The tool 60 can be a screwdriver, for example, having a drive profile which fits the drive profile 360 of the spindle 300.

Figure 6:
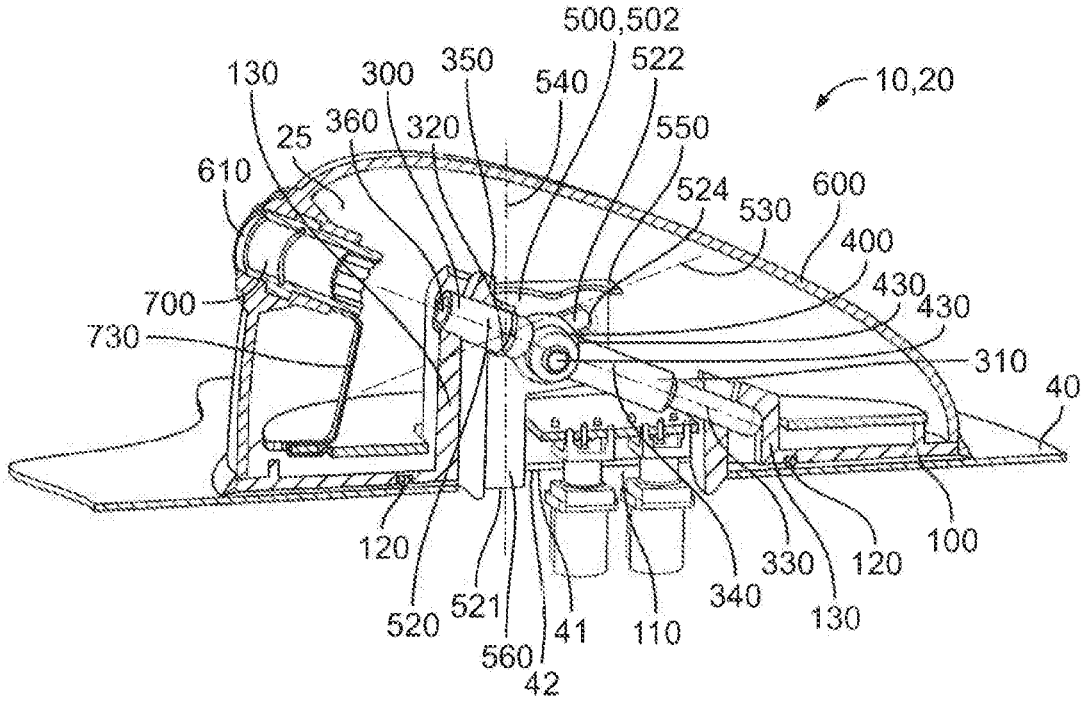
FIG. 6 is a sectional perspective view of the antenna base arranged on the mounting aperture after locking.
Figure 7:
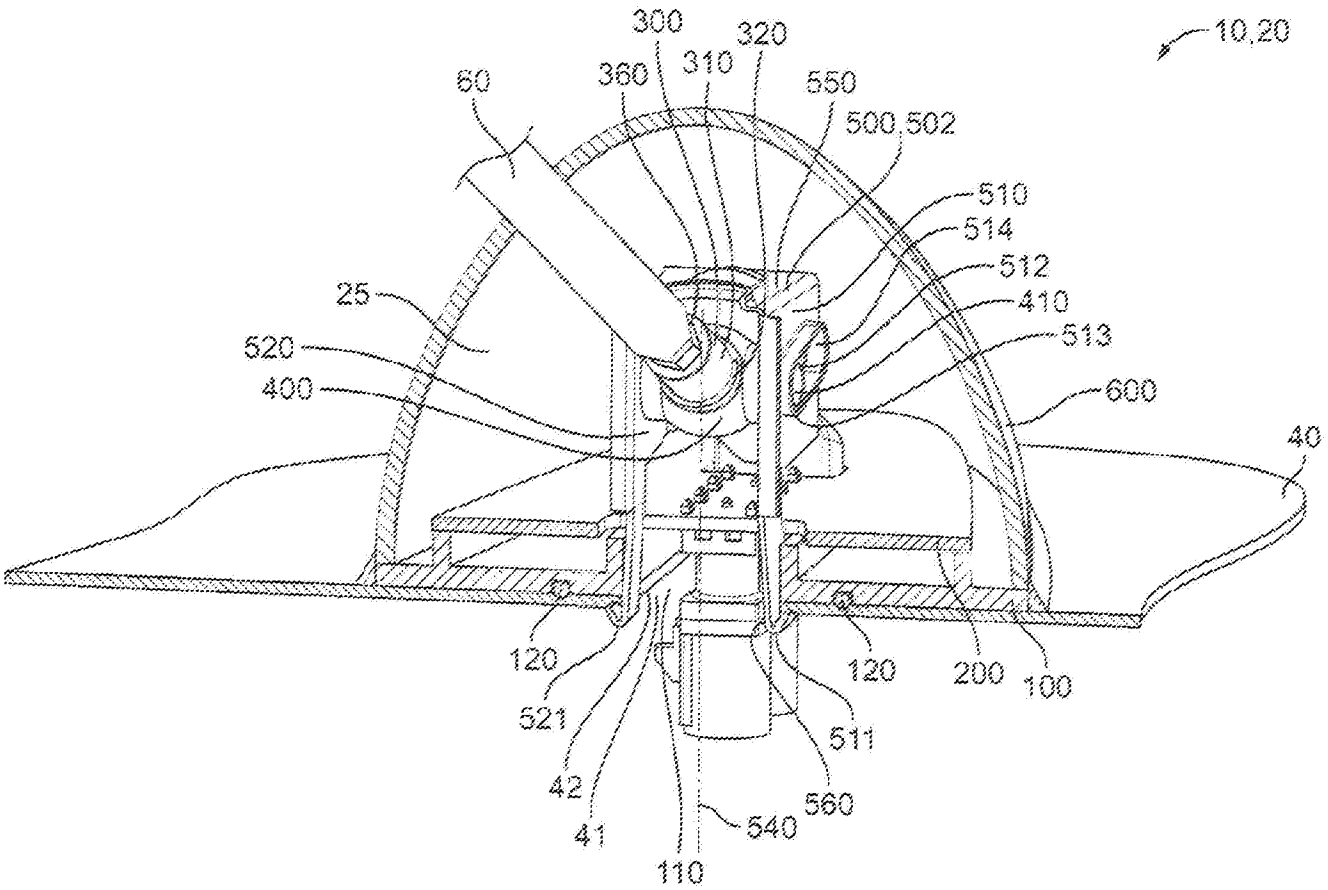
FIG. 7 is a sectional perspective view of the antenna base arranged on the mounting aperture after locking.

FIGS. 6 and 7 show partially sectional, perspective views of the antenna base 20, which is arranged on the mounting aperture 41 in the roof 40, in a situation chronologically following the depiction from FIGS. 4 and 5. In this case, FIGS. 6 and 7 show views from different viewing directions.

In the situation shown in FIGS. 6 and 7, the driver 400 has been moved in a translatory manner on the spindle 300, by rotating the spindle 300, to the extent that the pins 410, 420 of the driver 400 are now arranged close to the first longitudinal ends 513, 523 in the elongate holes 512, 522 of the locking element 500. As a result of the translatory movement of the driver 400, the locking element 500 has been displaced in the displacement direction 540 to the extent that the latching hooks 511, 521 now come to bear on the edge 42 of the mounting aperture 41 on the lower side of the roof 40 and, as a result, fix the antenna base 20 on the roof 40. At the same time, the limbs 510, 520 of the locking element 500 have been spread apart to the extent that the two latching hooks 511, 521 of the locking element 500 have come to bear on mutually facing sections of the edge 42 of the mounting aperture 41 in the roof 40.

In the mounted state shown in FIGS. 6 and 7, the antenna base 20 thus can no longer be removed from the mounting aperture 41 in the roof 40, without previously moving the driver 400 on the spindle 300 in such a way that the pins 410, 420 of the driver 400 are displaced from the first longitudinal ends 513, 523 of the elongate holes 512, 522 of the locking element 500 in the direction of the second longitudinal ends 514, 524.

Figure 8:
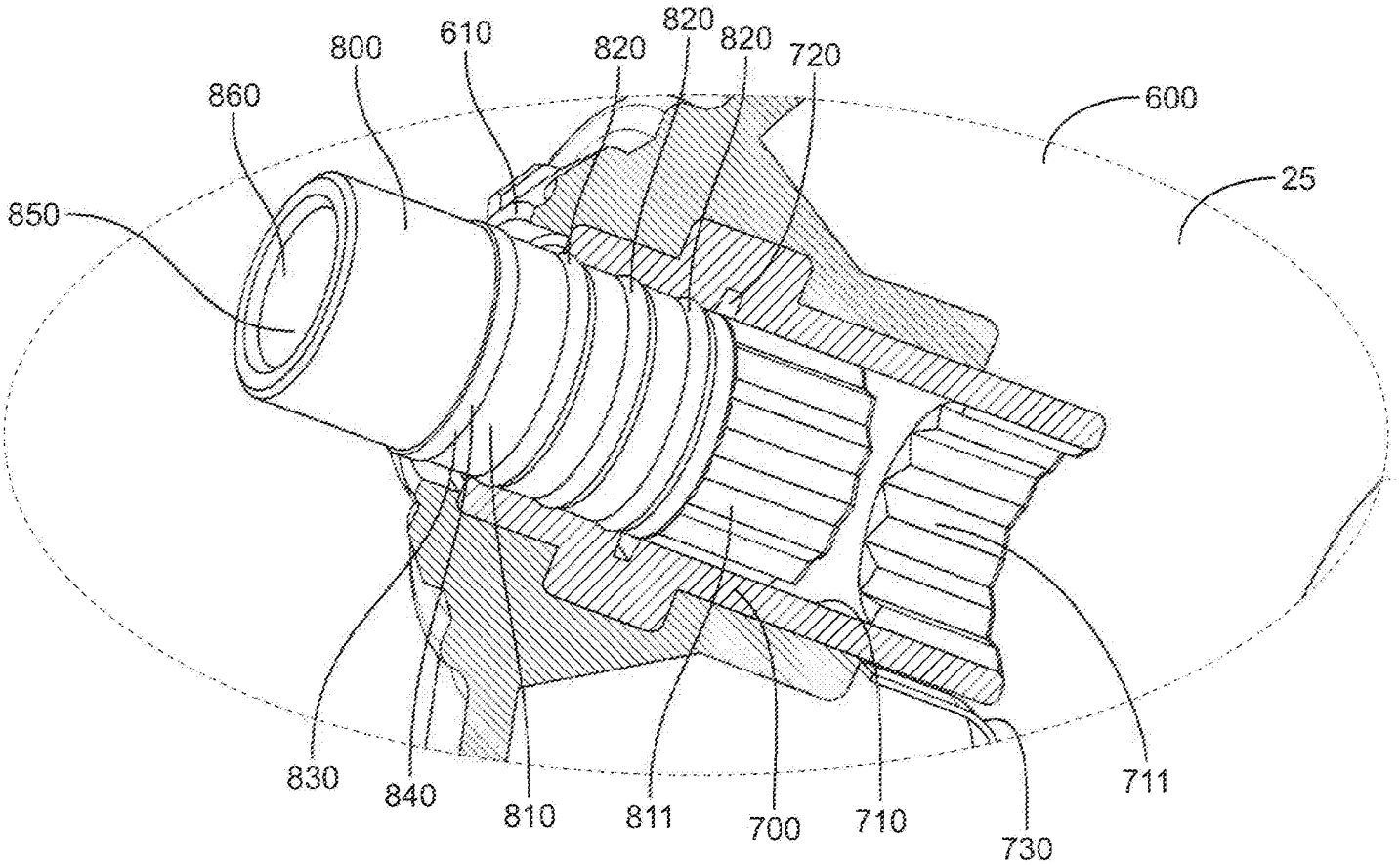
FIG. 8 is sectional perspective detail view of a cover of the roof antenna with an aperture, a socket arranged in the aperture, and a stopper which can be arranged in the socket.

FIG. 8 shows an enlarged and partially sectional depiction of the aperture 610 in the cover 600 of the antenna base 20 of the roof antenna 10. A socket 700 is arranged in the aperture 610 in the cover 600. The socket 700 can have a metal, for example. The socket 700 is inserted securely into the aperture 610 in the cover 600, such that a permanent and tight connection is produced between the socket 700 and the cover 600. For this purpose, the socket 700 can have suitable anchoring structures, for example an external hexagon, on an outer wall. The socket 700 has a continuous aperture with an inner wall 710. As a result, the aperture 610 in the cover 600 offers access to the inner region 25 of the antenna base 20 even with the socket 700 arranged in the aperture 610. For the above-described rotation of the spindle 300, the tool 60 used for this purpose can be inserted through the aperture 610 in the cover 600 and into the socket 700 arranged in the aperture 610.

In the embodiment shown in FIG. 8, the inner wall 710 of the socket 700 has a first splined shaft profile 711. However, the first splined shaft profile 711 can be dispensed with. Moreover, the inner wall 710 of the socket 700 has a peripheral first groove 720. The electrically conductive socket 700 is connected in an electrically conductive manner to an associated contact surface of the circuit board 200 via a contact spring 730 which is arranged in the inner region 25 of the antenna base 20.

Figure 9:
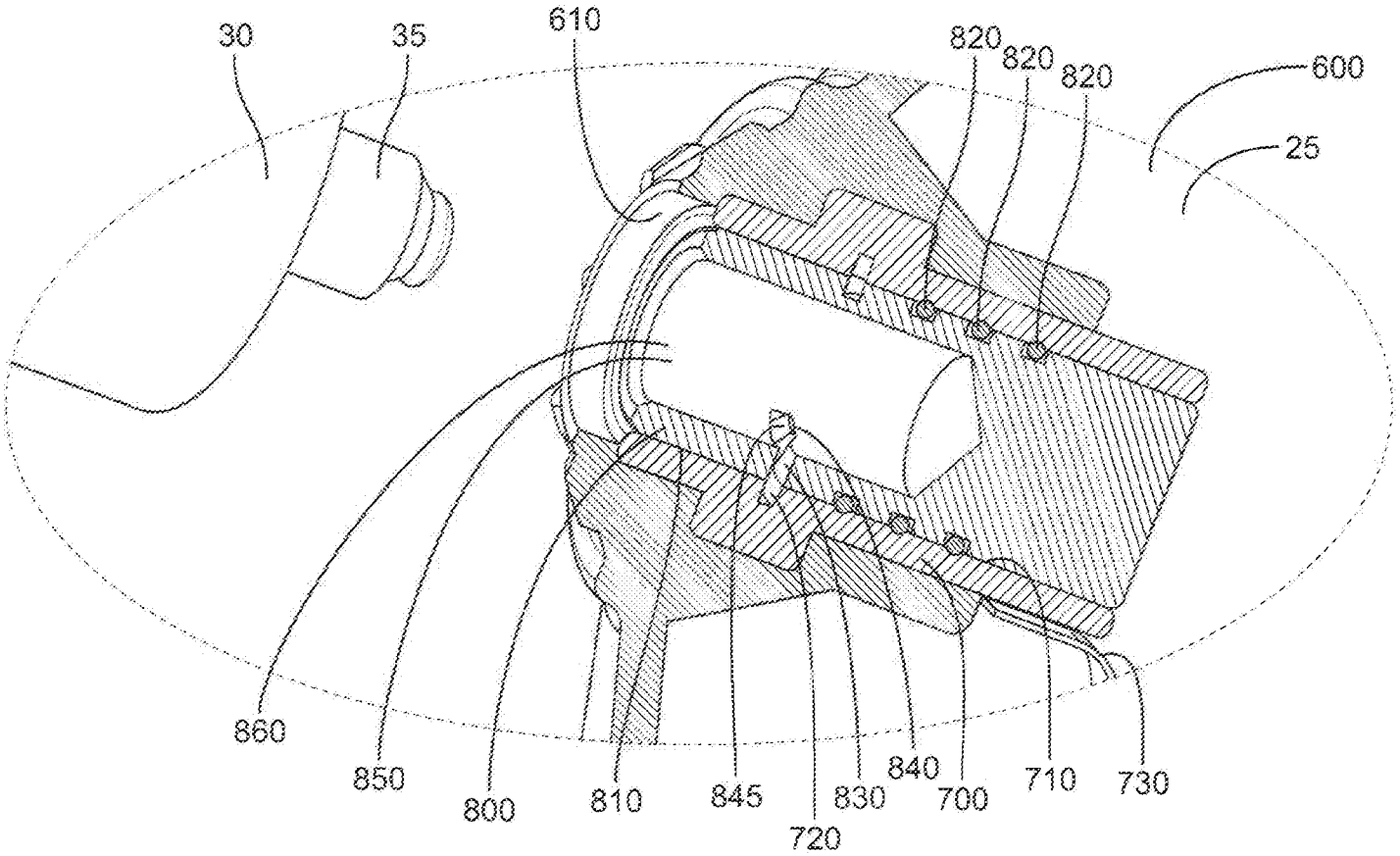
FIG. 9 is a sectional perspective detail view of the cover with the socket and the stopper arranged in the socket.

After the fixing of the antenna base 20 of the roof antenna 10 on the roof 40, it is expedient to seal the aperture 610 in the cover 600, in order to prevent the ingress of dirt and moisture into the inner region 25 of the antenna base 20. For this purpose, a stopper 800 is arranged in the socket 700, as shown in FIGS. 8 and 9. The stopper 800 is formed of an electrically conductive material, for example a metal. The stopper 800 has a cylindrical basic shape with an outer wall 810. The stopper 800 can be pushed into the socket 700, which is arranged in the aperture 610 in the cover 600, from the outer side of the antenna base 20. FIG. 8 shows a depiction with the stopper 800 only partially pushed into the socket 700. FIG. 9 shows a schematically sectional side view of the stopper 800 pushed fully into the socket 700.

In the embodiment shown in FIG. 8, the stopper 800 has, on its outer wall 810, a second splined shaft profile 811, which is formed to fit the first splined shaft profile 711 of the socket 700. As a result of the first splined shaft profile 711 and the second splined shaft profile 811, the stopper 800, which is arranged in the socket 700, is prevented from being twisted around a longitudinal axis of the socket 700 and of the stopper 800. This anti-twist protection can, however, also be achieved in a manner other than by way of the first splined shaft profile 711 and the second splined shaft profile 811. In this case, the splined shaft profiles 711, 811 can be dispensed with.

The stopper 800 is formed in a closed manner, as a result of which the aperture 610 in the cover 600 is sealed shut by the stopper 800. In order to also achieve a sealing of the region between the inner wall 710 of the socket 700 and the outer wall 810 of the stopper 800, one or more peripheral O-rings 820 can be provided on the outer wall 810 of the stopper 800. In the example shown in FIGS. 8 and 9, the stopper 800 has three coaxially arranged O-rings 820. These O-rings 820 are each arranged in grooves running around the outer wall 810 of the stopper 800. However, more or fewer than three O-rings 820 can also be provided. The sealing between the stopper 800 and the socket 700 can also be achieved in another way.

At an outer longitudinal end, the stopper 800 has a rod-receiving aperture 850 with a thread 860, as shown in FIGS. 8 and 9. The rod-receiving aperture 850 is provided for receiving a rod 30, shown in FIG. 9, of the roof antenna 10. The rod 30 can also be referred to as an antenna pole. The rod 30 has a thread 35, which can be screwed into the thread 860 of the rod-receiving aperture 850 in the stopper 800.

The outer wall 810 of the stopper 800 has a second groove 830, as shown in FIGS. 8 and 9. The second groove 830 is arranged on the outer wall 810 of the stopper 800 in such a way that the second groove 830 of the stopper 800 is arranged concentrically in relation to the first groove 720 on the inner wall 710 of the socket 700, when the stopper 800 is pushed fully into the socket 700. A peripheral securing ring 840 is arranged in the second groove 830 of the stopper 800. The second groove 830 has an opening, which extends from the outer wall 810 of the stopper 800 as far as the rod-receiving aperture 850. A projection 845 of the securing ring 840 extends through this opening and protrudes into the rod-receiving aperture 850. This can be seen in FIG. 9.

Figure 10:
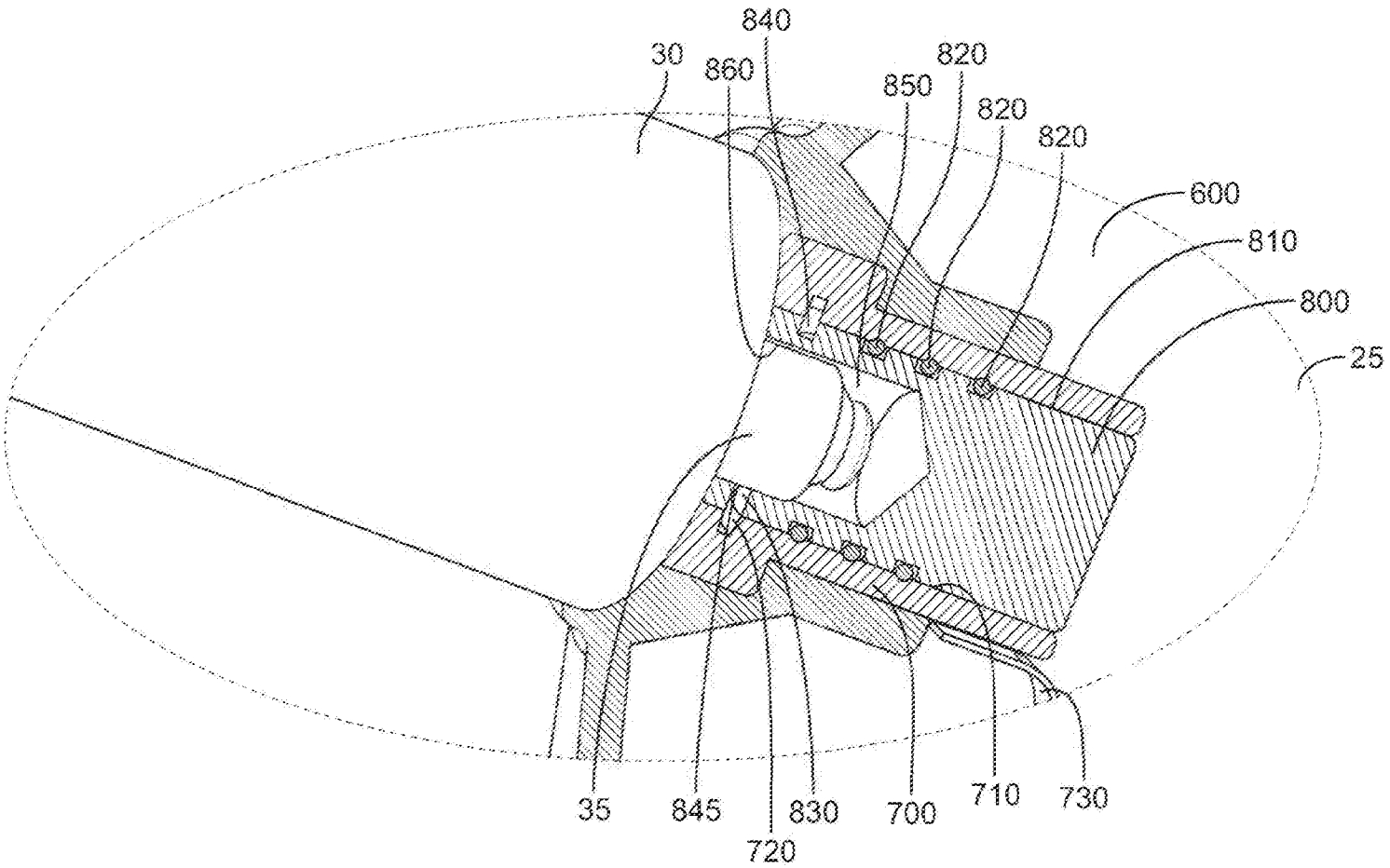
FIG. 10 is a sectional perspective detail view of the aperture in the cover, the socket, the stopper and a rod of the roof antenna screwed into the stopper.

After the stopper 800 has been arranged in the socket 700, the rod 30 can be screwed into the stopper 800. FIG. 10 shows a depiction of the aperture 610 in the cover 600, the socket 700 arranged in the aperture 610, the stopper 800 arranged in the socket 700 and the rod 30 screwed into the rod-receiving aperture 850 in the stopper 800. As a result of the rod 30 being screwed into the rod-receiving aperture 850, the projection 845 of the securing ring 840 protruding into the rod-receiving aperture 850 has been pressed outwards out of the rod-receiving aperture 850, with the result that the securing ring 840 has deformed elastically in such a way that it now protrudes partially into the first groove 720 of the socket 700, which first groove 720 is arranged concentrically in relation to the second groove 830 of the stopper 800. The result achieved is that the stopper 800 is fixed in the socket 700 and is secured against being pulled out unintentionally. The stopper 800 thus can no longer be removed from the socket 700 without unscrewing the rod 30 from the stopper 800 beforehand. There is an electrically conductive connection from the rod 30 to the circuit board 200 of the roof antenna 10 via the stopper 800, the socket 700 and the contact spring 730.

Figure 11:
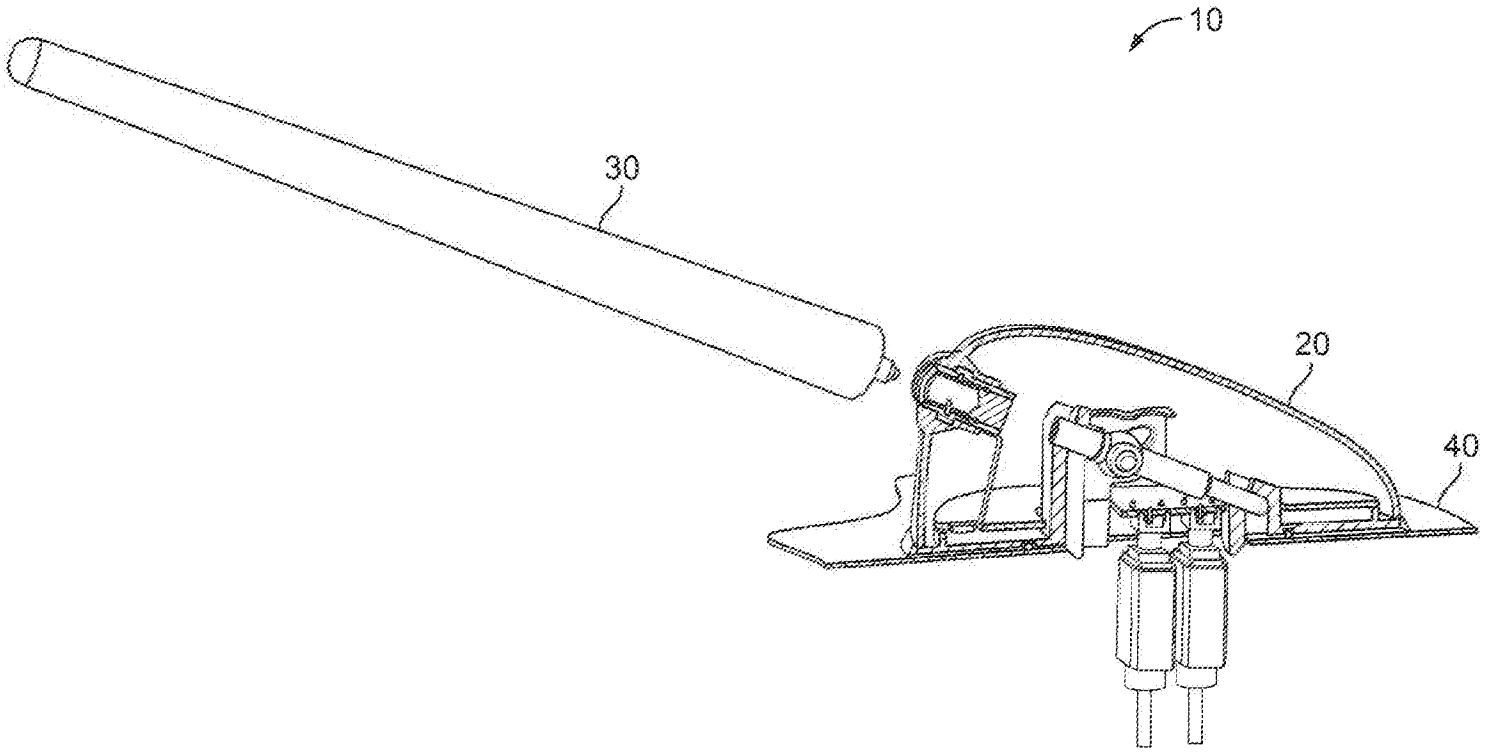
FIG. 11 is a sectional perspective view of the roof antenna mounted on the mounting aperture in the roof.

FIG. 11 shows a schematic, perspective and partially sectional depiction of the roof antenna 10 after completion of the mounting of the roof antenna 10 on the mounting aperture 41 in the roof 40. To dismount the roof antenna 10, the above-described mounting steps must be performed in reverse order. For this purpose, therefore, the rod 30 is initially unscrewed. The stopper 800 is then removed from the socket 700. Then, with the tool 60, the spindle 300 can be screwed in such a way that the locking element 500 is displaced along the displacement direction 540 in such a way that the latching hooks 511, 521 of the locking element 500 detach themselves from the edge 42 of the mounting aperture 41 and the locking element 500 returns from its spread-apart state 502 to its unstressed state 501. The antenna base 20 can then be lifted up from the mounting aperture 41 in the roof 40.

The roof antenna 10 can advantageously be mounted on an outer side of the roof 40 without access being required from an inner side of the roof 40. This is achieved by the antenna base 20 of the roof antenna 10 being able to be locked on the roof 40 by the locking element 500. In this case, the locking element 500 can be locked from the outer side of the roof 40 by the spindle 300 and the driver 400.

What is claimed is:

1. A roof antenna, comprising:

an antenna base with a base plate;

a spindle;

a driver arranged on the spindle; and a locking element having a first limb and a second limb, the first limb has a first latching hook and the second limb has a second latching hook, the first limb and the second limb extend through an aperture in the base plate, a translatory movement of the driver on the spindle is transferred into a displacement of the locking element in a displacement direction perpendicular to the base plate.

2. The roof antenna of claim 1, wherein the first limb and the second limb can be spread apart resiliently by the translatory movement of the driver on the spindle.

3. The roof antenna of claim 1, wherein the driver is arranged between the first limb and the second limb.

4. The roof antenna of claim 3, wherein the driver has a first pin and a second pin, the first limb has a first elongate hole and the second limb has a second elongate hole, the first pin is guided in the first elongate hole and the second pin is guided in the second elongate hole.

5. The roof antenna of claim 4, wherein a longitudinal direction of the spindle forms a first angle of less than 90 degrees with a longitudinal direction of the first elongate hole and the second elongate hole.

6. The roof antenna of claim 5, wherein the longitudinal direction of the spindle forms a second angle of less than 90 degrees with the displacement direction.

7. The roof antenna of claim 4, wherein the first limb and the second limb in an unstressed state have a spacing smaller at a first longitudinal end of the first elongate hole and the second elongate hole than at a second longitudinal end of the first elongate hole and the second elongate hole.

8. The roof antenna of claim 1, further comprising a cover, the spindle, the driver, and the locking element are arranged between the base plate and the cover.

9. The roof antenna of claim 8, wherein the cover has an aperture, the spindle is accessible through the aperture in the cover.

10. The roof antenna of claim 9, further comprising a socket with an inner wall arranged in the aperture of the cover.

11. The roof antenna of claim 10, further comprising a rod and a stopper with an outer wall, the stopper is arranged in the socket and the rod can be screwed into the stopper.

12. The roof antenna of claim 11, wherein the inner wall of the socket has a first splined shaft profile and the outer wall of the stopper has a second splined shaft profile that fits the first splined shaft profile.

13. The roof antenna of claim 11, wherein an O-ring is arranged on the outer wall of the stopper.

14. The roof antenna of claim 11, wherein the stopper has a securing ring that locks to the stopper in the socket when the rod is screwed into the stopper.

15. The roof antenna of claim 1, wherein the antenna base has a plug connector accessible at the aperture in the base plate.

16. A method for mounting a roof antenna, comprising:

providing the roof antenna including an antenna base with a base plate, a spindle, a driver arranged on the spindle, and a locking element having a first limb and a second limb, the first limb has a first latching hook and the second limb has a second latching hook, the first limb and the second limb extend through an aperture in the base plate, a translatory movement of the driver on the spindle is transferred into a displacement of the locking element in a displacement direction perpendicular to the base plate;

arranging the antenna base over a mounting aperture with the first limb and the second limb extending through the mounting aperture; and rotating the spindle to displace the locking element with the driver so the first latching hook and the second latching hook bear on an edge of the mounting aperture.

17. The method of claim 16, wherein the roof antenna has a cover, a socket arranged in an aperture of the cover, a rod, and a stopper.

18. The method of claim 17, further comprising arranging the stopper in the socket and screwing the rod into the stopper.

19. The method of claim 16, wherein the antenna base has a plug connector accessible at the aperture in the base plate.

20. The method of claim 17, further comprising connecting a cable to the plug connector.

* * * * *